United States Patent [19]

Hill

[11] Patent Number: 4,568,222

[45] Date of Patent: Feb. 4, 1986

[54] MINE-ROOF SUPPORTS

[75] Inventor: Nigel Hill, Pershore, England

[73] Assignee: Dowty Mining Equipment Limited, United Kingdom

[21] Appl. No.: 620,444

[22] Filed: Jun. 14, 1984

[30] Foreign Application Priority Data

Jun. 22, 1983 [GB] United Kingdom ..... 8316941

[51] Int. Cl.[4] ..... E21D 15/44

[52] U.S. Cl. ..... 405/299; 405/297

[58] Field of Search ..... 405/290, 291, 292, 295–301; 299/31, 33

[56] References Cited

U.S. PATENT DOCUMENTS 3,915,500 10/1975 Schlusener ..... 405/299 X 3,952,525 4/1976 Walker et al. ..... 405/298

4,183,701 1/1980 Oppenlander et al. ..... 405/295

*Primary Examiner*—David H. Corbin

*Attorney, Agent, or Firm*—Hayes, Davis & Soloway

[57] ABSTRACT

A mine-roof support has a floor beam, an advancing ram and a relay bar. A bell-crank lever is pivotally-connected to the floor beam and the advancing ram is pivotally-connected to the bell-crank lever. One arm of the bell-crank lever has a member which may be in the form of a ball. The pivotal connections are such that, on extension of the ram, when the relay bar is connected to part of a conveyor, the bell-crank lever is initially urged downwardly from an inoperative position away from contact with the relay bar, into an operative position in contact with the relay bar, thereby to apply an upward thrust to the front end of the support and to maintain an upward thrust during further extension of the ram and consequential advancing movement of the mine-roof support towards the conveyor.

1 Claim, 3 Drawing Figures

MINE-ROOF SUPPORTS

This invention relates to mine-roof supports.

When a mine-roof support is in use in a mine, it is necessary at certain periods of time to cause the mine-roof support to be released from supporting a roof at one position in the mine, to be advanced to a new position and, when it is in that new position, to cause it to support the roof above the new position.

Such advancing movement is effected by means of an extensible and contractible ram which is connected between the mine-roof support and part of a conveyor which runs in front of a plurality of the mine-roof supports which are arranged, side-by-side, along a mineral face being mined.

A mine-roof support is heavy and, during its advance towards a conveyor, its front end may dig into the floor of the mine or meet an obstruction on the floor. Either will interfere with the advance of the mine-roof support towards a conveyor.

Several arrangements have been proposed to overcome this problem but they have been complicated and/or expensive.

It is an object of this invention to provide an improved mine-roof support.

According to this invention, a mine-roof support has (i) a floor-engaging member, (ii) a roof-engageable member, (iii) prop means by which the roof-engageable member can be moved away from and towards the floor-engaging member, (iv) a lever pivotally-connected to the forward end portion of the floor-engaging member, (v) a ram having one part thereof pivotally-connected to the lever and extending towards the rear of the floor-engaging member, and (vi) a relay bar pivotally-connected to another part of the ram and arranged for pivotal connection, at its forward end portion, to a part of a conveyor which, when the mine-roof support is in use, will be in front of the mine-roof support, (vii) said lever being arranged, on extension of the ram, when the relay bar is connected to a part of a conveyor, initially to be urged downwardly from an inoperative position away from contact with the relay bar, into an operative position in contact with the relay bar, thereby to apply an upward thrust to the front end of the support and to maintain an upward thrust during further extension of the ram and consequential advancing movement of the mine-roof support towards the conveyor.

The upward thrust is related to the resistance to which the mine-roof support is subjected during its advancing movement. The upward thrust will be small when there is little or no resistance, and will be high when there is resistance, such as for example, that due to a tendency of the mine-roof support to penetrate a soft floor over which it advances.

Figure 1:
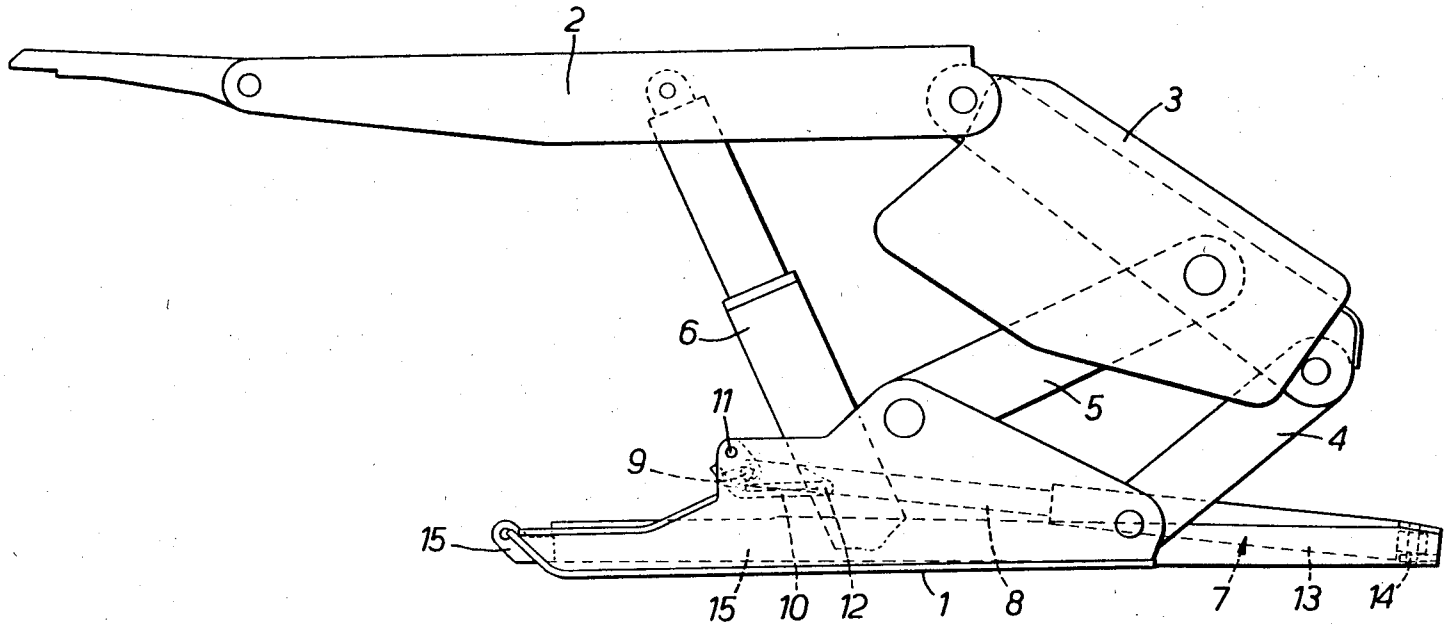
Figure 2:
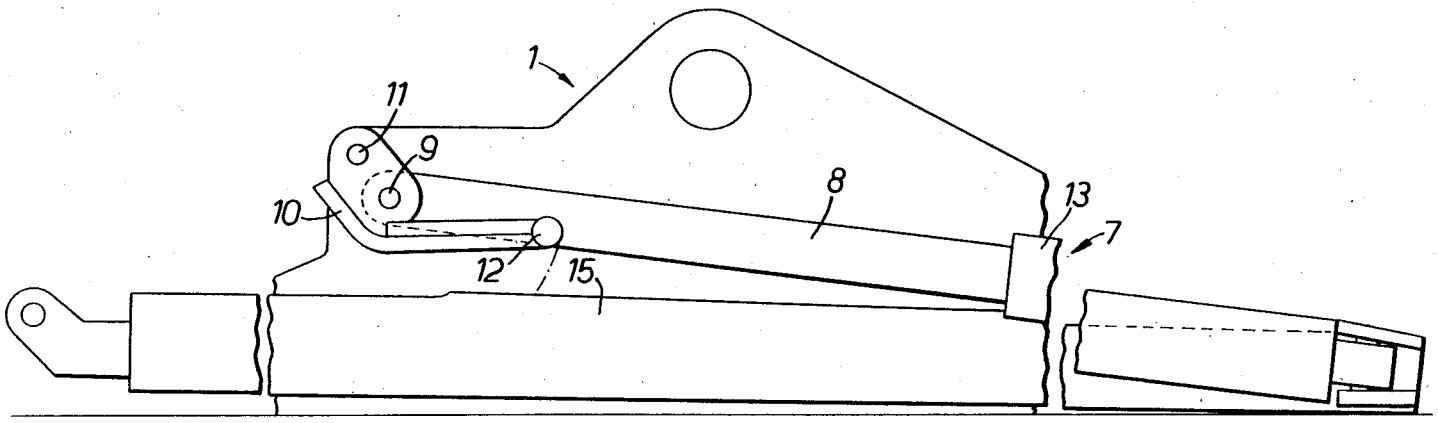
Figure 3:
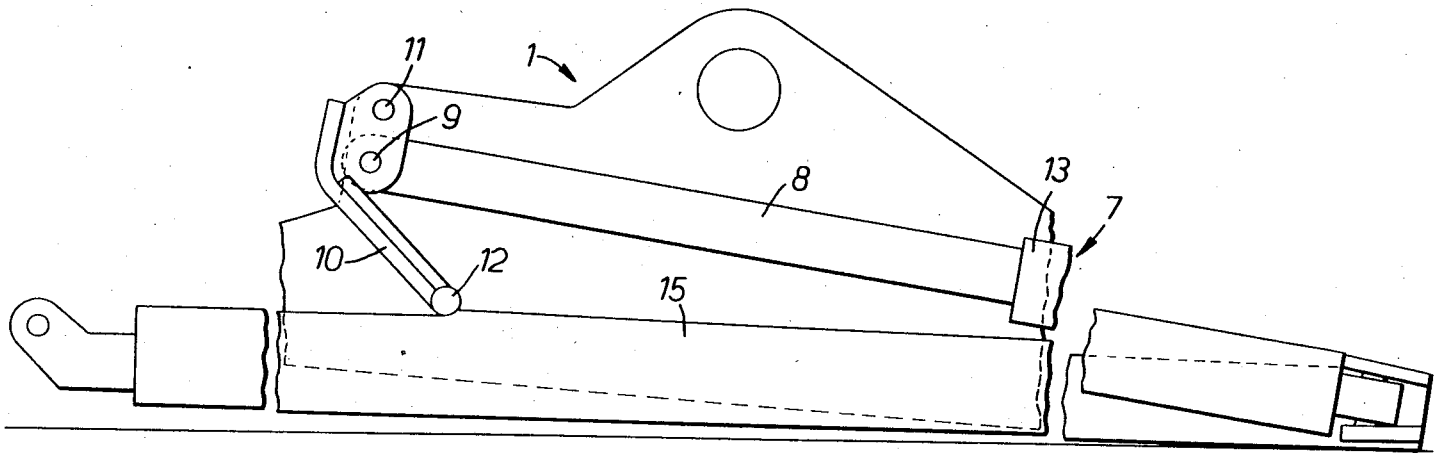

A mine-roof support in accordance with one embodiment of the invention is illustrated in the accompanying drawings of which FIG. 1 is a side elevational view of the mine-roof support, FIG. 2 is a scrap view of part of the mine-roof support shown in FIG. 1, prior to extension of its advancing ram, and FIG. 3 is a view of that part of the mine-roof support shown in FIG. 2 during advance of the support.

Referring to the drawings, the mine roof support includes a floor-engaging member 1, a roof-engageable member 2, a shield 3 and links 4 and 5 interconnecting those two members, and a pair of hydraulically-operated telescopic props 6 (only one of which is visible in the drawings) by means of which the roof-engageable member 2 can be moved with respect to the floor-engaging member 1.

The mine-roof support also includes an advancing ram 7. The piston rod 8 of the ram 7 is pivotally-connected at 9 to a position intermediate the ends of a bell-crank lever 10, one arm of which is pivotally-connected at 11 to the floor-engaging member 1. The other end of the bell-crank lever 10 has a member 12 in the form of a ball or, as another example, a cylindrical shoe.

The cylinder 13 of the ram 7 is pivotally-connected at 14 to the rearward end of a relay bar 15. The forward end of the relay bar 15, when the mine-roof support is in use in a mine, will be pivotally-connected to a part of a conveyor (not shown) in front of the mine-roof support.

Prior to the advancing movement of the mine-roof support towards a conveyor, the ram 7 will be in a contracted condition. Initially, when the ram 7 is energised to advance the mine-roof support towards a conveyor, the piston rod 8 will cause the bell-crank lever 10 to move from the position shown in FIGS. 1 and 2, where it is out of contact with the relay bar 15, until it takes up a position with the member 12 urged tightly against the relay bar 15 (FIG. 3). This will cause an upward thrust to be applied to the forward end of the floor-engaging member 1 and continued extension of the ram 7 will not only maintain this upward thrust but will cause the mine-roof support to advance towards the conveyor.

When, subsequently, the part of the conveyor in front of the mine roof support has to be moved away from the mine-roof support, as will be necessary in practice, initial contraction of the ram 7 will move the bell-crank lever 10 from its operative position in contact with the relay bar 15 (FIG. 3) to its inoperative position above the relay bar 15 (FIGS. 1 and 2). Further contraction of the ram 7 will cause the relay bar 15 to move the conveyor away from the mine-roof support.

If desired, the relay bar, when connected to a conveyor may be inclined forwardly and upwardly away from its pivotal connection with the ram.

In an alternative embodiment the bell-crank lever may be reversed, one arm of the bell-crank lever extending beyond the pivot point 11, with the pivot-connection point 9 being on that arm, and the other arm of the bell-crank lever may extend forwardly of the roof support instead of rearwardly as in the embodiment described with reference to the drawings.

I claim:

1. A mine-roof support having (i) a floor-engaging member, (ii) a roof-engageable member, (iii) prop means by which the roof-engageable member can be moved away from and towards the floor-engaging member, (iv) a lever pivotally-connected to the forward end portion of the floor-engaging member, (v) a ram having one part thereof pivotally-connected to the lever and extending towards the rear of the floor-engaging member, and (vi) a relay bar pivotally-connected to another part of the ram and arranged for pivotal connection, at its forward end portion, to a part of a conveyor which, when the mine-roof support is in use, will be in front of the mine-roof support, (vii) said lever being arranged, on extension of the ram, when the relay bar is connected to a part of a conveyor, initially to be urged downwardly from an inoperative position away from contact with the relay bar, into an operative position in contact with the relay bar, thereby to apply an upward thrust to the front end of the support and to maintain an upward thrust during further extension of the ram and consequential advancing movement of the mine-roof support towards the conveyor.

* * * * *